US009347295B2

(12) United States Patent
Tingat Cody et al.

(10) Patent No.: US 9,347,295 B2
(45) Date of Patent: May 24, 2016

(54) FILTRATION SYSTEM AND METHOD FOR A PACKER

(71) Applicant: Schlumberger Technology Corporation, Sugar Land, TX (US)

(72) Inventors: Kathiravane Tingat Cody, Amiens (FR); Pierre-Yves Corre, Amiens (FR); Stephane Metayer, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 403 days.

(21) Appl. No.: 13/801,477

(22) Filed: Mar. 13, 2013

(65) Prior Publication Data

US 2014/0131031 A1 May 15, 2014

Related U.S. Application Data

(60) Provisional application No. 61/726,338, filed on Nov. 14, 2012.

(51) Int. Cl.

| | |
|---|---|
| ***E21B 43/08*** | (2006.01) |
| ***E21B 33/12*** | (2006.01) |
| ***E21B 49/08*** | (2006.01) |
| ***E21B 49/10*** | (2006.01) |

(52) U.S. Cl.

CPC ..... *E21B 43/086* (2013.01); *E21B 33/12* (2013.01); *E21B 43/08* (2013.01); *E21B 49/08* (2013.01); *E21B 49/081* (2013.01); *E21B 49/087* (2013.01); *E21B 49/10* (2013.01) E21B 33/12; E21B 49/081

See application file for complete search history.

(56) References Cited

U.S. PATENT DOCUMENTS

| | | | | |
|---|---|---|---|---|
| 3,739,915 | A * | 6/1973 | Kehoe et al. | 210/394 |
| 4,538,683 | A | 9/1985 | Chulick | |

(Continued)

FOREIGN PATENT DOCUMENTS

| | | | |
|---|---|---|---|
| WO | 2005114134 | A2 | 12/2005 |
| WO | 2012054865 | A2 | 4/2012 |

OTHER PUBLICATIONS

International Search Report and the Written Opinion for International Application No. PCT/US2013/031551 dated Aug. 23, 2013.

(Continued)

*Primary Examiner* — Brad Harcourt
(74) *Attorney, Agent, or Firm* — Kenneth L. Kincaid

(57) ABSTRACT

Filtration systems, methods and/or apparatuses for use on a packer system are provided. Filtration assemblies and/or filters may prevent mud, gravel, and/or other solids from clogging and/or entering drains on a packer. The filters and/or filtration assemblies may have multiple dynamic components to prevent debris from entering the packer system. Rotary filters, cylindrical filters, and/or belt filters may be used to clear fluid obstructions from sampling drains. Helices and/or turbines may harness power of fluid flowing through the drains and/or flowlines to operate moving dynamic components of systems and/or apparatuses. The filters and/or filtration assemblies may be interchangeable such that various filters may be used on a single packer system.

14 Claims, 9 Drawing Sheets

(56) References Cited

U.S. PATENT DOCUMENTS

| | | | | |
|---|---|---|---|---|
| 7,603,897 | B2 | 10/2009 | Gilbert et al. | |
| 7,647,968 | B2 | 1/2010 | Corbett et al. | |
| 2005/0167159 | A1 | 8/2005 | Bailey et al. | |
| 2008/0217002 | A1 | 9/2008 | Simonds et al. | |
| 2010/0071898 | A1* | 3/2010 | Corre et al. | 166/264 |
| 2010/0218943 | A1 | 9/2010 | Nold, III et al. | |
| 2010/0258300 | A1 | 10/2010 | Shoemate | |
| 2011/0220347 | A1* | 9/2011 | Kayser | 166/235 |

OTHER PUBLICATIONS

EP Search Report issued in related EP application 13855481 on Mar. 24, 2016, 4 pages.

* cited by examiner

FILTRATION SYSTEM AND METHOD FOR A PACKER

CROSS-REFERENCE TO RELATED PATENT APPLICATIONS

The present application claims priority to U.S. Provisional Patent Application No. 61/726,338 filed Nov. 14, 2012, the entirety of which is incorporated by reference.

FIELD OF THE INVENTION

The present disclosure generally relates to the evaluation of a subterranean formation. More specifically, the present disclosure relates to a filtration system for a downhole packer system.

BACKGROUND INFORMATION

Underground formation testing is beneficial and is performed during drilling and geotechnical investigation of underground formations. Testing of such underground formations is important as the results of such examinations may determine, for example, if a driller proceeds with drilling and/or extraction. Since drilling operations are extremely expensive on a per day basis, excessive drilling impacts the overall economic viability of drilling projects. There is a need, therefore, to minimize the amount of drilling and to obtain accurate information from the underground formations.

Different types of information may be obtained from the underground formations. One of the primary forms of information is obtained using actual samples of fluid, from underneath the ground surface. Such samples, when they are obtained, are analyzed to determine the constituents of the underground formation.

Determination of the underground fluid constituents is important in the exploration for trapped hydrocarbon reserves. Determination of oil, gas or mixtures of oil and gas are of primary importance in many areas of the world, and correct determination of the presence of these constituents is valuable.

Difficulty often arises, however, in sampling of the oil and gas from these formations. Many formations may be under tremendous underground pressures that hamper the recovery efforts. To limit the amount of pressure from traveling uphole, operators may use specific engineering control methods, such as installing a device called a "packer" that limits the flow of fluid to the uphole environment. These packers are conveyed inside the formation by various methods and then expanded/inflated at a point of interest. The expansion limits the fluid, or in some instances, eliminates fluid penetration to the uphole environment from the packer installation through the obstruction caused by the packer. Packers use drains/ports for sampling formation fluid. Oftentimes, mud, rock and other debris may become clogged in and/or caked on drains. This clogging may lead to problems, such as, for example, inaccuracies in sample intake and/or measurement.

A need exists for providing system and/or method that allows for more accurate sampling of underground fluids without the clogging problems experienced by conventional systems.

DETAILED DESCRIPTION

Figure 1:
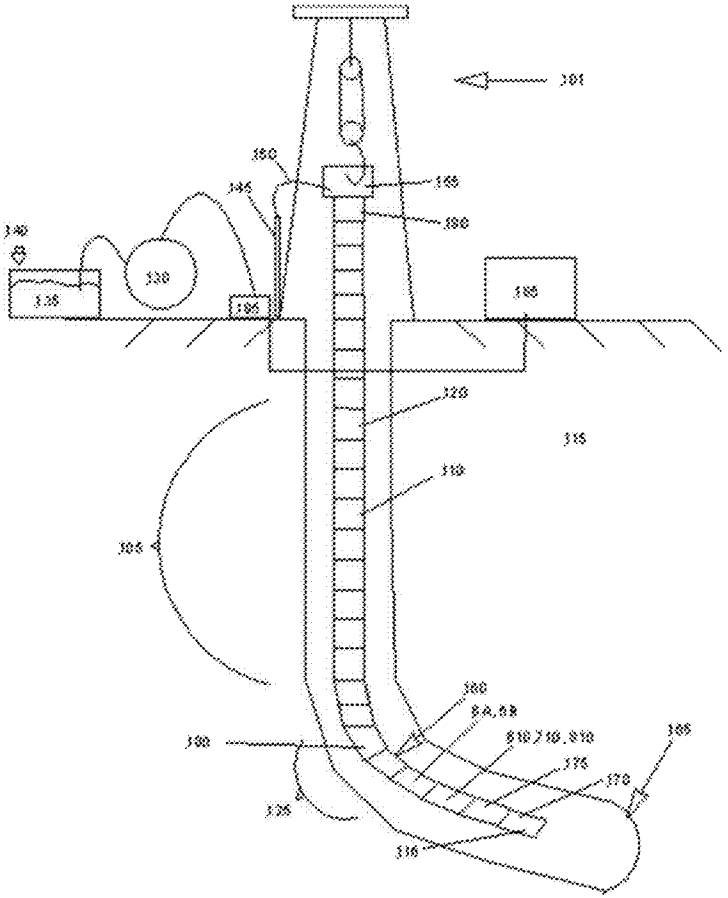
FIG. 1 shows a side view of a drill rig system in one aspect described, wherein the drill rig system prepares a wellbore in a geotechnical subsurface environment.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The example filtration assemblies described herein may be used on a packer to sample fluids in a subterranean formation. More specifically, the example filtration assemblies described herein may prevent mud, gravel, and/or other solids from clogging and/or entering drains on a packer.

The present disclosure illustrates a system and method, for collecting formation fluid through a port or drain in the body of an inflatable or expandable packer. The collected formation fluid may be conveyed along an outer layer of the packer to a tool flow line and then directed to a desired collection location. Use of the packer to collect a sample enables the use of larger expansion ratios and higher drawdown pressure differentials. Additionally, because the packer uses a single expandable sealing element, the packer is better able to support the formation in a produced zone at which formation fluids are collected. This quality facilitates relatively large amplitude drawdowns even in weak, unconsolidated formations.

The packer is expandable across an expansion zone to collect formation fluids from a position along the expansion zone, i.e. between axial ends of the outer sealing layer. Formation fluid may be collected through one or more ports or drains having fluid openings in the packer for receiving formation fluid into an interior of the packer. The drains may be positioned at different radial and longitudinal distances. For example, separate drains may be disposed along the length of the packer to establish collection intervals or zones that enable focused sampling at a plurality of collecting intervals, e.g. two or three collecting intervals. The drains may have filters and/or filtration assemblies to prevent solids from entering the packer. The filtration assemblies may have one or more components, such as, for example, a helix, a turbine, a rotary filter, a cylindrical filter, a scraper, and/or a brush. The filtration assemblies of the drains may have static and/or dynamic components. The components may be moved and/or operated by the fluid flow through the drain, the flow line, and/or the packer.

The collected formation fluid may be directed along flow lines, e.g. along flow tubes, having sufficient inner diameter to transport the formation fluid. Separate flowlines may be connected to different drains to enable the collection of unique formation fluid samples. In other applications, sampling may be conducted by using a single drain placed between axial ends of the packer sealing element.

In accordance with the present disclosure, a wellsite with associated wellbore/well 110 and apparatus is described to exhibit a typical, but not limiting, environment in which an embodiment of the application may be installed. To that end, the apparatus at the wellsite may be altered, as necessary, due to field considerations encountered. The apparatus may be installed using various techniques, hereinafter described.

Referring now to the drawings wherein like numerals refer to like parts, FIG. 1 shows one embodiment of a well system 101 as deployed in a wellbore 110. The well system 101 comprises a conveyance 105 employed to deliver at least one packer 160 into the wellbore 110. In many applications, the packer 160 is used on a modular dynamics formation tester (MDT) tool deployed by the conveyance 105 in the form of a wireline. However, the conveyance 105 may have other forms, including tubing strings, such as a coiled tubing, drill strings, production tubing, casing or other types of conveyance depending on the required application. In the embodiment illustrated, the packer 160 is an inflatable or extendable packer used to collect formation fluids from a surrounding formation 115. The packer 160 is selectively expanded in a radially outward direction to seal across an expansion zone. For example, the packer 160 may be inflated by fluid, such as wellbore fluid, hydraulic fluid or other fluid. When the packer 160 is expanded to seal against the wellbore 110, formation fluids may flow into the packer 160, The formation fluids may then be directed to a tool flow line and produced to a collection location, such as a location at a well site surface.

As shown in FIG. 1, the conveyance 105 may extend from a rig 101 into a zone of the formation 115. In an embodiment, the packer 160 may be part of a plurality of tools 125, such as a plurality of tools forming a modular dynamics formation tester. The tools 125 may collect the formation fluid, test properties of the formation fluid, obtain measurements of the wellbore, formation about the wellbore or the conveyance 105, or perform other operations as will be appreciated by those having ordinary skill in the art. The tools 125 may be measuring while drilling ("MWD") and/or logging while drilling ("LWD") tools, for example such as shown by numerals 6*a*, 6*b*. In an embodiment, the downhole tools 6*a* and 6*b* may be a formation pressure MWD tool.

In an embodiment, the tools 125 may include LWD tools having a thick walled housing, commonly referred to as a drill collar, and may include one or more of a number of logging devices. The LWD tools may be capable of measuring, processing, and/or storing information therein, as well as communicating with equipment disposed at the surface of the well site. As another example, the MWD tools may include one or more of the following measuring components: a modulator, a weight on bit measuring device, a torque measuring device, a vibration measuring device, a shock measuring device, a stick slip measuring device, a direction measuring device, an inclination measuring device and\or any other device. As yet another example, the tools 125 may include a formation capture device 170, a gamma ray measurement device 175 and a formation fluid sampling tool 610, 710, 810 which may include a formation pressure measurement device 6*a* and/or 6*b*. The signals may be transmitted toward the surface of the earth along the conveyance 105.

Measurements obtained or collected may be transmitted via a telemetry system to a computing system 185 for analysis. The telemetry system may include wireline telemetry, wired drill pipe telemetry, mud pulse telemetry, fiber optic telemetry, acoustic telemetry, electromagnetic telemetry or any other form of telemetering data from a first location to a second location. The computing system 185 is configurable to store or access a plurality of models, such as a reservoir model, a fluid analysis model, a fluid analysis mapping function.

The rig 101 or similar looking/functioning device may be used to move the conveyance 105. Several of the components disposed proximate to the rig 101 may be used to operate components of the overall system. For example, a drill bit 116 may be used to increase the length (depth) of the wellbore. In an embodiment where the conveyance 105 is a wireline, the drill bit 116 may not be present or may be replaced by another tool. A pump 130 may be used to lift drilling fluid (mud) 135 from a tank 140 or pits and discharges the mud 135 under pressure through a standpipe 145 and flexible conduit 150 or hose, through a top drive 155 and into an interior passage inside the conveyance 105. The mud 135, which may be water or oil-based, exits the conveyance 105 through courses or nozzles (not shown) in the drill bit 116. The mud 135 may cool and/or lubricate the drill bit 116 and lift drill cuttings generated by the drill bit 116 to the surface of the earth through an annular arrangement.

When the well 110 has been drilled to a selected depth, the tools 125 may be positioned at the lower end of the conveyance 105 if not previously installed. The tools 125 may be coupled to an adapter sub at the end of the conveyance 105 and may be moved through, for example in the illustrated embodiment, a highly inclined portion 165 of the well 110.

During well logging operations, the pump 130 may provide fluid flew to operate one or more turbines in the tools 125 to provide power to operate certain devices in the tools 125. When tripping in or out of the well 110, the mud pumps 130 may be turned on and off to provide fluid flow. As a result, power may be provided to the tools 125 in other ways. For example, batteries may be used to provide power to the tools 125. In one embodiment, the batteries may be rechargeable batteries and may be recharged by turbines during fluid flow. The batteries may be positioned within the housing of one or more of the tools 125. Other manners of powering the tools 125 may be used including, but not limited to, one-time power use batteries.

An apparatus and system for communicating from the conveyance 105 to the surface computer 185 or other component configured to receive, analyze, and/or transmit data may include a second adapter sub 190 that may be coupled between an end of the conveyance 105 and the top drive 155, The top drive 155 that may be used to provide a communication channel with a receiving unit 195 for signals received from the tools 125. The receiving unit 195 may be coupled to the surface computer 185 to provide a data path therebetween that may be a bidirectional data path.

The conveyance 105 may alternatively be connected to a rotary table (not shown), via a kelly, and may suspend from a traveling block or hook (not shown) and a rotary swivel (not shown), The rotary swivel may be suspended from the drilling rig 101 through the hook, and the kelly may be connected to the rotary swivel such that the kelly may rotate with respect to the rotary swivel. The kelly may be any mast that has a set of polygonal connections or splines on the outer surface type that mate to a kelly bushing such that actuation of the rotary table may rotate the kelly. An upper end of the conveyance 105 may be connected to the kelly, such as by threadingly reconnecting the drill string 105 to the kelly, and the rotary table may rotate the kelly, to rotate the drill string 105 connected thereto.

Figure 2:
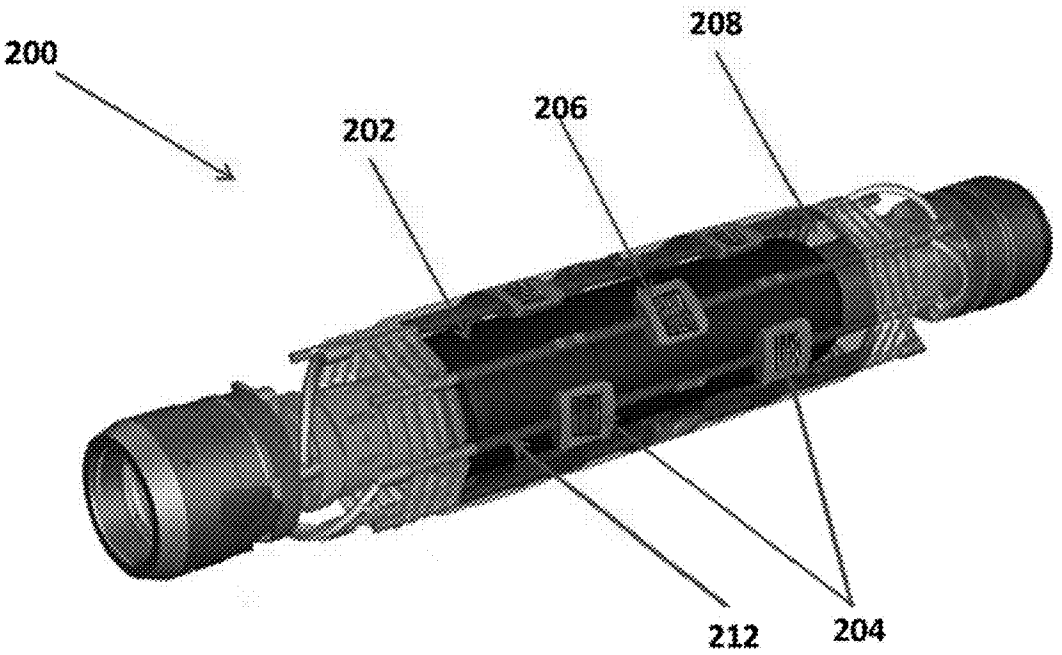
FIG. 2 shows a perspective view of a packer system with guard drains and a single central sampling drain that may be used in the geotechnical substrate environment to carry out embodiments of the present disclosure.

FIG. 2 illustrates an embodiment of a packer system 200. For example, the packer system 200 may be the packer 160 as shown in FIG. 1 or may be deployed into a wellbore for other uses. The packer system 200 may be described as a "packer" for brevity in some circumstances. The packer system 200 may be used to fluidly isolate one portion of a wellbore from another portion of a wellbore. The packer system 200 is conveyed to a desired downhole location and, in the non-limiting embodiment provided, inflated or expanded to provide a seal between the packer system 200 and the well 110. For example, the packer system may prevent fluid communication from two portions of a wellbore by expanding or inflating circumferentially to abut the wellbore.

The packer system 200 may have one or more ports or sampling drains 204, 206 (the terms drains or ports are used herein interchangeably, and no inference should be drawn from use of one term without the other) for receiving fluid from the formation or the wellbore into the packer system 200. In an embodiment, the packer system 200 has one or more guard ports 204 located longitudinally from one or more sample ports 206. In the illustrated embodiment, the guard ports 204 are illustrated at a closer longitudinal distance from ends of the packer system than a longitudinal distance of the one or more sample ports 206 to the ends of the packer system 200. The ports 204, 206 may be located at distinct radial positions about the packer system 200 such that the ports 204, 206 contact different radial positions of the wellbore.

The ports 204, 206 may be embedded radially into a sealing element of an outer layer of the packer system 200. By way of example, the sealing element may be cylindrical and formed of an elastomeric material selected for hydrocarbon based applications, such as nitrile rubber (NBR), hydrogenated nitrile butadiene rubber (HNBR), and fluorocarbon rubber (FKM). The packer system 200 may be expanded or inflated, such as by the use of wellbore fluid, hydraulic fluid, mechanical means or otherwise positioned such that one or more of the sample ports 206 and one or more of the guard ports 204 may abut the walls of the formation 115 to be sampled. The packer system 200 may be expanded or inflated from a first position to a second position such that the outer diameter of the packer system 200 is greater at the second position than the first position. In an embodiment, the second position may be the position in which the ports 204, 206 abut the formation, and the first position may be an unexpanded or deflated position. The packer system 200 may move to a plurality of positions between the first position and the second position. The packer system 200 may expand in the relative areas around the one or more guard ports 204 and the one or more sample ports 206. A tight seal may be achieved between the exterior of the packer system 200 and wellbore, casing pipe or other substance external to the packer system 200.

Operationally, the packer system 200 is positioned within the wellbore 110 to a sampling location. The packer system 200 is inflated or expanded to the formation through the expansion of the body 202 of the packer system 200 expanding with the internal diameter of the pipe or within the formation 115. A pump may be utilized to draw fluid from the ports 204, 206 and/or to transport fluid within or out of the packer system 200. Flowlines 212 may transfer the fluid drawn from the drains 204, 206 to other portions of the packer system 200 and/or a downhole tool. The pump may be incorporated into the packer system 200, may be external to the packer system 200, and/or may be incorporated into each of the individual drains 204, 206. The fluid removed through the sample drain 206 and/or guard drains 204 may then be transported through the packer system 200 to a downhole tool, such as, for example, the tools 125 shown in FIG. 1.

In an alternative configuration, the packer system 200 may retain the fluid in an interior system for later analysis when the packer system 200 is deflated or unexpanded and retrieved. An outer seal layer is provided around the periphery of the remainder of the packer system 200 to allow for mechanical wear of the unit as well as sealing capability to the formation 115 or inner wall of the wellbore. The packer system 200 may have an inner, inflatable bladder disposed within an interior of an outer seal layer 208. The flowlines 212 may be embedded in, disposed beneath, and/or affixed atop the outer seal layer 208.

Figure 3:
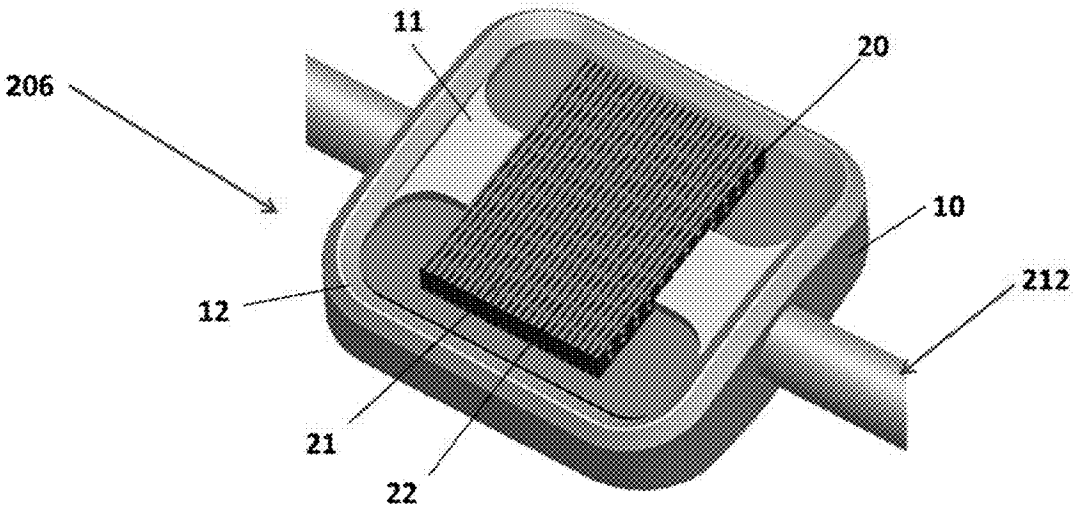
FIG. 3 shows a perspective view of a drain that may be used in accordance with one or more aspects of the present disclosure.
Figure 4:
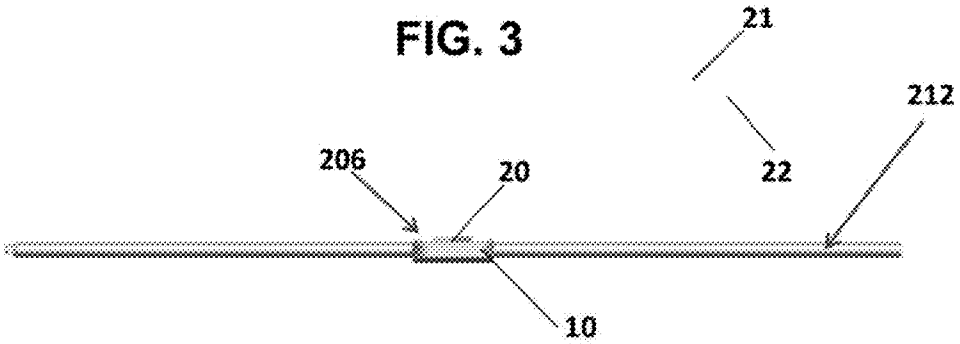
FIG. 4 shows a side elevation view of a drain and flowline that may be used in accordance with one or more aspects of the present disclosure.

FIGS. 3 and 4 show a drain 206 with a filter assembly in accordance with one or more aspects of the present disclosure. Although the term "drain" may be used for simplicity to describe numerous embodiments of drains or ports of a packer system 200, it should be noted that the drains of the foregoing description may be sample drains 206 and/or guard drains 204. The drain 206 may have a body 10 with a top surface 11 having a rim 12 circumferentially disposed about the edges of the top surface 11. The drain 206 may have one or more flowlines 212 extending from the body 10. The drain 206 may be disposed on a packer assembly 200 such as that shown with respect to FIG. 1 and/or FIG. 2. The body 10 may be generally hollow with one or more components disposed therein. The drain 206 may have a filter 20 for preventing mud, stone and/or other particles from being drawn into the drain 206. The filter 20 may have a plurality of lamellae 21 with spaces 22 and/or holes 23 disposed therebetween. The size of the lamellae 21 of the filter 20 may vary. Moreover, a single drain 206 with a single filter 20 may have lamellae 21 of multiple sizes, width, and/or height.

Figure 5A:
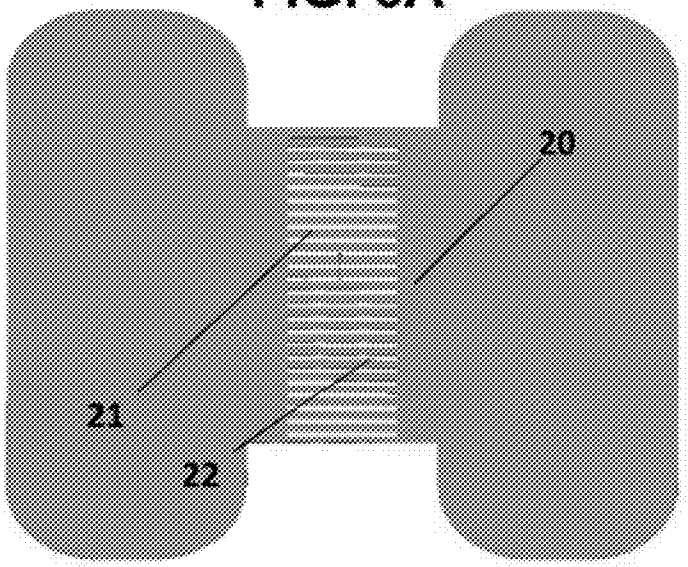
FIG. 5A shows a top plan schematic view of a filter to be used on a drain in accordance with one or more aspects of the present disclosure.
Figure 5B:
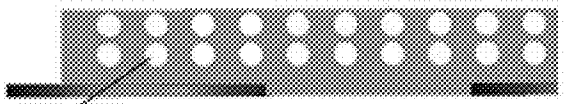
FIGS. 5B and 5C show examples of filters that may be used on drains in accordance with one or more aspects of the present disclosure.
Figure 5C:
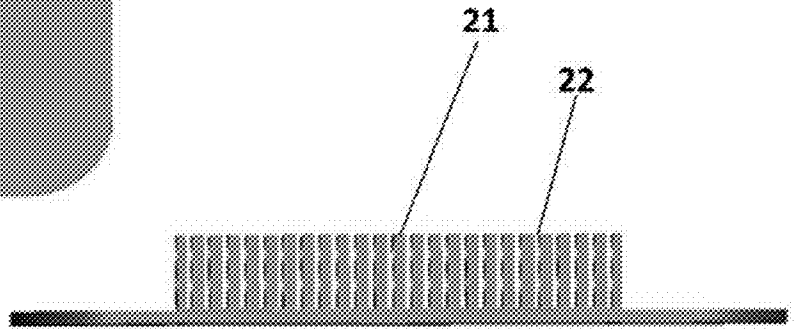

FIG. 5A shows a top plan schematic view of the filter 20 that may be used on the drain 206 in accordance with one or more aspects of the present disclosure. FIGS. 5B and 5C show examples of filters 20 that may be used on the drains 206 in accordance with one or more aspects of the present disclosure. The filter 20 shown in FIG. 5B has a plurality of holes 23. The holes 23 may be sized and/or spaced according to characteristics of the wellbore in which the packer system 200 may be used. For example, the holes 23 may be 2 mm in diameter to prevent rocks and/or gravel with a diameter larger than 2 mm from being drawn into the drain 206. The filter 20 shown in FIG. 5C has the lamellae 21. The size and/or the spacing of the lamellae 21 may also vary depending on the characteristics of the wellbore. For example, the lamellae 21 may be 1 mm thick and/or may be spaced 0.5 mm apart.

As illustrated in FIG. 2, the drains 204, 206 may be arranged on the outer layer 208 of the packer system 200. During sampling, the filters 20 of the drains 204, 206 may catch large amounts of mud and/or rock (hereinafter collectively referred to as "debris"), Excessive buildup of debris on the drains 204, 206 may restrict the flow of fluid into the packer system 200 during future tests. Thus, the filter(s) 20 may be cleaned using a reverse fluid flow. During the reverse fluid flow, fluid is pumped through the flowlines 212 and out of the drains 204, 206.

Figure 6A:
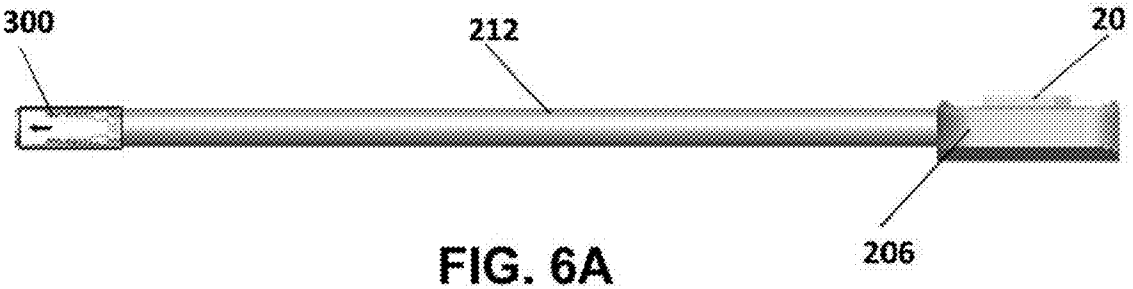
FIG. 6A shows a drain coupled to a directional valve in accordance with one or more aspects of the present disclosure.

FIG. 6A shows the drain 206 coupled to a directional valve 300. When used in the packer system 200, the directional valve 300 may be used to reverse the sampling flow to clear any debris from the filter 20 of the drain 206. The directional valve 300 may be coupled to the drain 206 via the flowline 212.

Figure 6B:
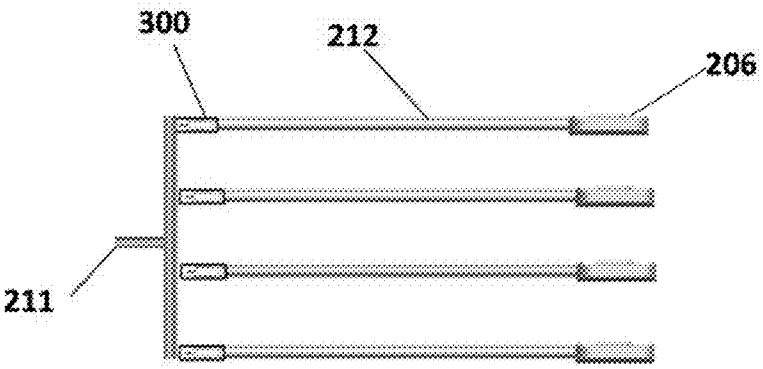
FIG. 6B shows an example of a configuration of a plurality of drains and directional valves that may be used on a packer system in accordance with one or more aspects of the present disclosure.

FIG. 6B shows an example of a configuration of a plurality of drains and directional valves that may be used on the packer system 200. Typically, in a packer system of the prior art, two or more drains may be directly coupled to a single pump via a flowline. If only one of the drains is clogged, the reverse fluid flow will be siphoned out of the three unobstructed drains. Therefore, the debris may never be cleared from the one clogged drain, Thus, the configuration shown in FIG. GB has a directional valve 300 in circuit with each of the drains 206. The directional valve 300 may be operable to reverse flow in either direction. If the drain 206 is unobstructed, the directional valve 300 may resist flow towards the unobstructed drain due to the lack of pressure in the flowline 212. Conversely, pressure due to a clogged drain may cause the directional valve 300 to allow fluid to pass to unclog the drain 206. The directional valves 300 may also facilitate equal flow through all of the drains 206. Thus, if four drains are connected in circuit, all four drains may experience the same flow. The directional valves 300 may be arranged in any configuration with respect to the flowlines 212 and/or the drains 206.

Figure 7:
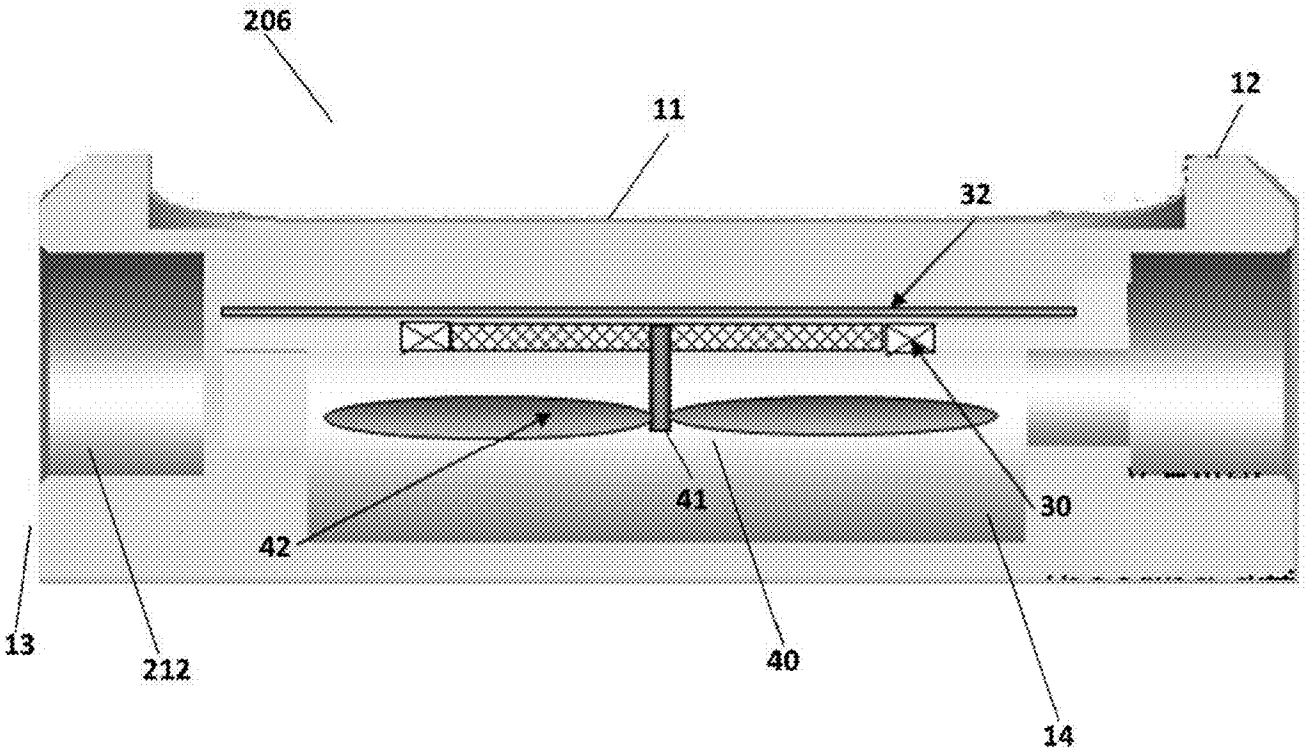
FIG. 7 shows a cross sectional view of a drain that may be used on a packer system in accordance with one or more aspects of the present disclosure.

FIG. 7 shows a cross sectional view of the drain 206 that may be used on the packer system 200 in accordance with one or more aspects of the present disclosure. As shown, an interior 14 may have one or more components for obstructing and/or removing debris from the drain 206. A rotary filter 30 may be composed of lamellae similar to that of the exterior filter 20 described with respect to FIG. 4, FIG. 5A, FIG. 56 and FIG. 5C. The rotary filter 30 may be in fixed rotational communication with an axle 41 of a helix 40. The helix 40 may have one or more helical blades 42. The helical blades 42 of the helix 40 may be caused to rotate due to the flow of fluid through the interior 14 of the drain 206. The rotation of the helix 40 may cause the rotary filter 30 to rotate as well. The rotary filter 30 may be abutted to or disposed below a scraper 32 and/or a brush. The scraper 32 and/or the brush may be fixed with respect to the rotary filter 30. Thus, rotating of the filter 30 may cause debris to be removed and/or loosened by the scraper 32. Removal of debris using the filter 30 and/or the scraper 32 may occur during sampling and/or reverse-flow cleaning carried out by the packer system 200. The flowlines 212 are shown extending from the sides 13 of the drain 206. Fluid flowing into and/or out of the interior 14 of the drain 206 may cause the helix 40 to rotate. Thus, the helix 40, the filter 30, and/or the scraper 32 of the drain 206 are self-servicing in that they operate while the packer system 200 is operating without requiring additional power or force. The drain 206 shown in FIG. 7, may be used in the configurations shown in FIGS. 6A and 6B to aid in reverse-flow cleaning.

Figure 8A:
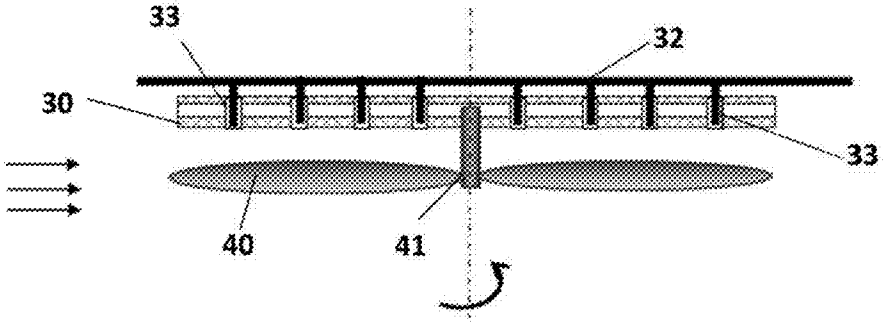
FIGS. 8A and 8B show another embodiment of a rotary filter in accordance with one or more aspects of the present disclosure.
Figure 8B:
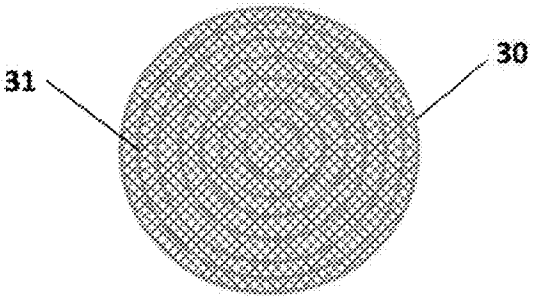

FIGS. 8A and 8B show another embodiment of the rotary filter 30, the helix 40, and the scraper 32 in accordance with one or more aspects of the present disclosure. As shown, the rotary filter 30 may have grooves 31 corresponding to a plurality of barbs 33 extending from the scraper 32. The grooves 31 may be circular and/or may define a track through which the barbs 33 may extend. The helix 40 may be caused to rotate by fluid flow through the drain 206. The rotary filter 30 may be in fixed rotational communication with the axle 41 of the helix 40 such that the rotary filter 30 rotates during fluid flow. The barbs 33 extending from the scraper 32 may aid in removing debris from the filter 30. The scraper 32 may have flexible bristles (not shown). Thus, the scraper 32 may act as a brush to remove debris from the filter 30 using bristles.

FIG. 8B shows a top plan view of the rotary filter 30 from FIG. 8*k* As illustrated, the rotary filter 30 may be circular and may have circular grooves 31. The grooves 31 may accommodate corresponding barbs 33 that may extend from the scraper 32. The filter 30 may be composed pursuant to the embodiments described with respect to FIGS. 3, 5A, 5B and 5C. Thus, different filter sizes and/or designs known to one having ordinary skill in the art may be used.

Figure 9A:
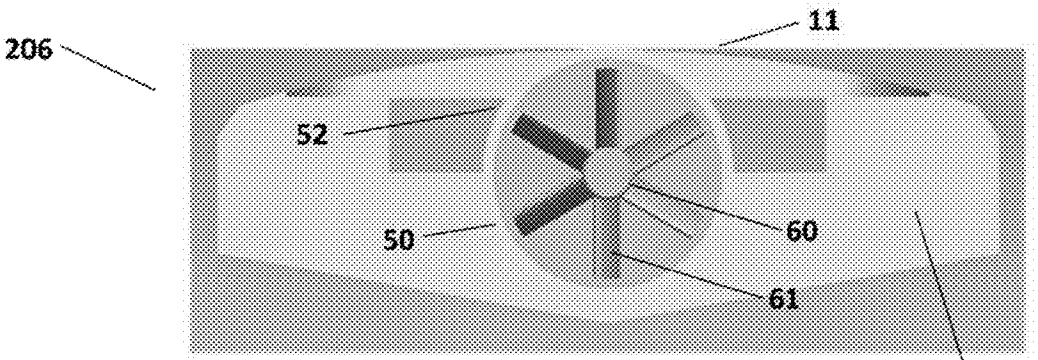
FIGS. 9A and 9B show cross sectional views of a drain with a cylindrical filter assembly in accordance with one or more aspects of the present disclosure.
Figure 9B:
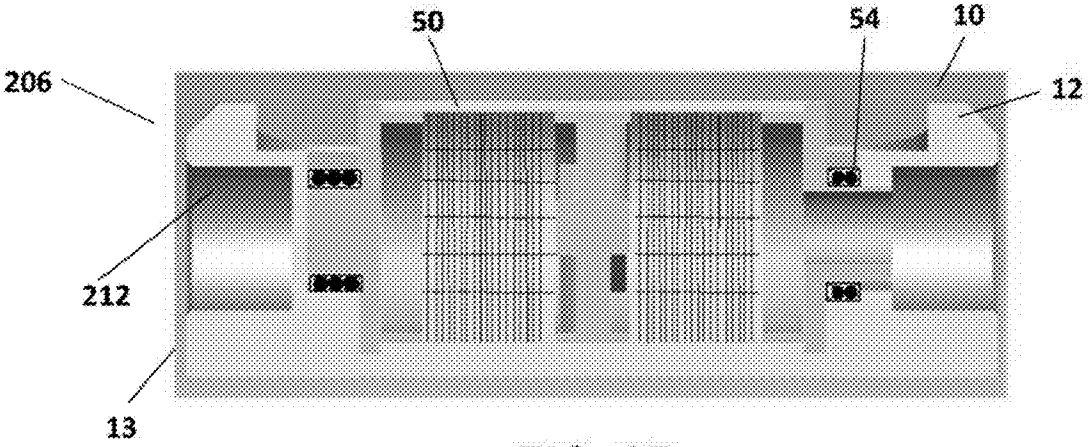

FIGS. 9A and 9B show cross sectional views of a drain 206 with a cylindrical filter assembly in accordance with one or more aspects of the present disclosure. As shown, the drain 206 may have a cylindrical filter 50 that may be in fixed rotational communication with the helix 40 or a turbine 60. The turbine 60 may have one or more blades 61. The blades 61 may be affixed at a 20 degree angle with respect to one another. Fluid flow through the interior 14 of the drain 206 may cause the turbine 60 to rotate. In turn, the filter 50 may rotate. The scraper 52 may be located at or near the extremities of the cylindrical filter 50. As the filter 50 rotates, the scrapers 52 may remove any debris caked onto the filter 50.

FIG. 9B shows a cross sectional side view of the drain 206 with a cylindrical filter assembly. As shown, the cylindrical filter 50 may extend from the top surface 11 of the drain body 10. Thus, the filter 50 and the scrapers 52 may prevent debris from entering the interior 14 of the drain 206. The filter 50 allows fluid to enter the drain 206. A mechanism may be used in combination with the turbine 60 and/or the cylindrical filter 50 to reduce rotational friction. The mechanism may be, for example, ball bearings 54 as shown in FIG. 9B.

The flowlines 212 may enter the drain 206 through the sides 13. The configuration of the turbine 60 is such that flow entering from the flowlines 212 is conveyed directly onto the turbine blades 61. The cylindrical filter 50 may be composed of perforated filter material. Moreover, the cylindrical filter 50 may be composed according to the embodiments set forth with respect to FIGS. 3, 5A, 56 and 50. Furthermore, the cylindrical filter 50 may have a varying diameter and/or thickness depending on drain size and/or application. For example, the cylindrical filter 50 may have an outer diameter of 24 mm, an inner diameter of 22 mm, and a thickness of 2 mm.

Figure 10:
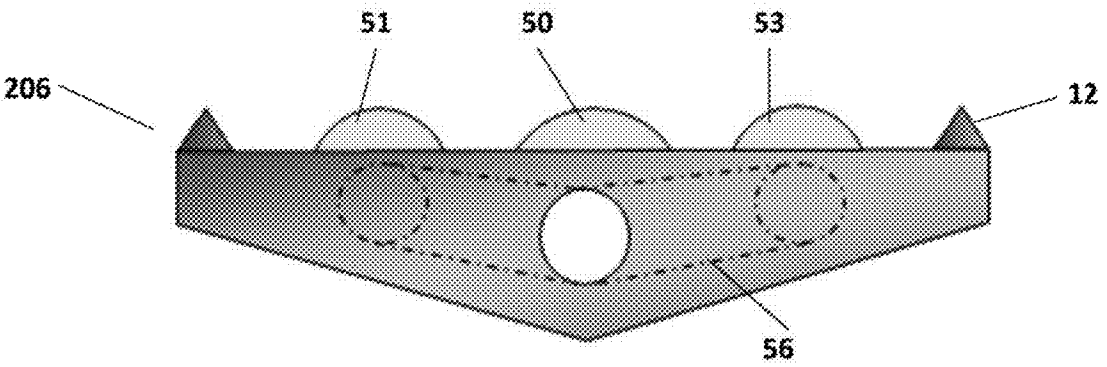
FIG. 10 shows a cross sectional view of a drain with multiple cylindrical filters in accordance with one or more aspects of the present disclosure.

In an embodiment, the drain 206 may have two or more cylindrical filters 50, 51, 53 as shown in FIG. 10. A chain or belt 56 may be connected between the filters 50, 51, 53. Thus, one of the filters 50 may have the turbine 60. The turbine 60 may cause the first filter 50 to rotate thereby causing the second filter 51 and/or the third filter 53 to rotate via the belt 56.

Figure 11:
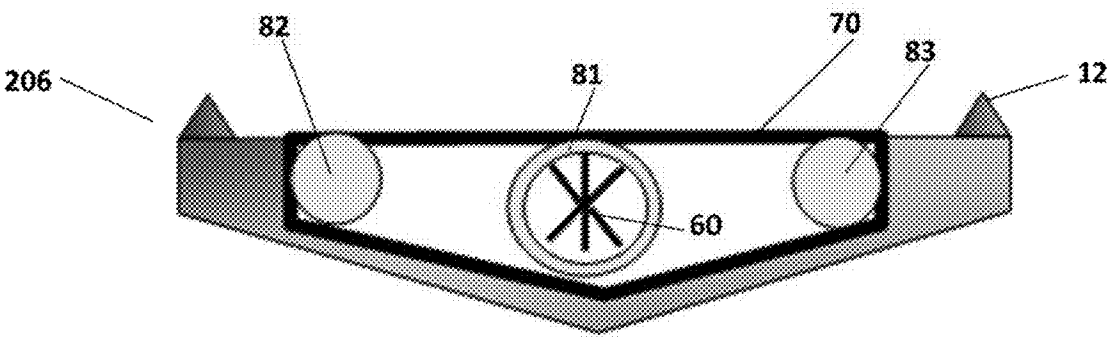
FIG. 11 shows a cross sectional view of a drain with a belt filter in accordance with one or more aspects of the present disclosure.

In another embodiment, a filter belt 70 may be mounted on one or more cylinders 81, 82, 83 as shown in FIG. 11. The filter belt 70 may be composed of a flexible material, such as, for example, cloth. The first cylinder 81 may be coupled to the turbine 60 to cause rotation of the belt 70. The second cylinder 82 and/or the third cylinder 83 may be passive or may have the turbines 60 as well. The filter belt 70 may be permeable to fluid, but may restrict mud and/or particles from entering the drain 206.

The filtering assemblies described herein may be adapted to be installed and/or removed from the body 10 of the drain 206. Thus, the filtering assemblies and/or components may be interchangeably used on the packer system 200. A cap or other mechanism may allow for the filtration assembly to be easily attached and/or detached from the packer system 200.

In a method of using the disclosed filtration system, the body 10 of the drain 206 may be mounted to the packer system 200. Next, a filtration assembly, such as those described herein may be placed into the body 10. An affixing mechanism may be enabled or applied to secure the filtration assembly within the body 10. The packer system 200 may then be used downhole for sampling and/or any other testing. After sampling, reverse fluid flow may be initiated to remove remaining debris from the drains.

In one non-limiting example embodiment, an apparatus is illustrated, comprising a body having at least one drain, the body mounted within a packer system, a filtration assembly within the body and the at least one drain, the filtration assembly configured with a plurality of lamellae and an affixing mechanism configured to secure the filtration assembly within the body.

The preceding description has been presented with reference to present embodiments. Persons skilled in the art and technology to which this disclosure pertains will appreciate that alterations and changes in the described structures and methods of operation can be practiced without meaningfully departing from the principle and scope of the disclosure. Accordingly, the foregoing description should not be read as pertaining only to the precise structures described and shown in the accompanying drawings, but rather should be read as consistent with and as support for the following claims, which are to have their fullest and fairest scope.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures.

What is claimed is:

1. An apparatus, comprising:

a body having at least one drain, the body mounted within a packer system; and a filtration assembly within the body and the at least one drain, wherein the filtration assembly comprises:

a rotary filter configured to rotate in response to fluid flowing into or out of an interior of the at least one drain without the use of additional power or force; and a stationary scraper disposed adjacent to the rotary filter, wherein the stationary scraper is configured to remove debris from a surface of the rotary filter.

2. The apparatus of claim 1, wherein the rotary filter comprises a plurality of lamellae.

3. The apparatus of claim 1, wherein the rotary filter is in fixed rotational communication with an axle of a helix having one or more helical blades.

4. The apparatus of claim 3, wherein the axle is parallel to a direction of flow through the at least one drain.

5. The apparatus of claim 3, wherein the helix is configured to rotate in response to fluid flowing into or out of an interior of the at least one drain without the use of additional power or force.

6. The apparatus of claim 1, wherein the rotary filter comprises a plurality of grooves, and the stationary scraper comprises a plurality of barbs or flexible bristles configured to engage with the plurality of grooves.

7. The apparatus of claim 6, wherein the grooves comprise circular grooves.

8. The apparatus of claim 6, wherein the rotary filter is in fixed rotational communication with an axle of a helix having one or more helical blades, and the helix is configured to rotate in response to fluid flowing into or out of an interior of the at least one drain without the use of additional power or force.

9. The apparatus of claim 1, wherein the rotary filter comprises a cylindrical filter in fixed rotational communication with a helix or turbine, and the helix or turbine is configured to rotate in response to fluid flowing into or out of an interior of the at least one drain without the use of additional power or force.

10. The apparatus of claim 9, wherein an axis of the helix or turbine is perpendicular to a direction of flow through the at least one drain.

11. The apparatus of claim 9, comprising:

a plurality of cylindrical filters; and a chain or belt coupling together the plurality of cylindrical filters.

12. The apparatus of claim 11, wherein a first one of the plurality of cylindrical filters is in fixed rotational communication with the helix or turbine, and the first one is configured to cause the remaining plurality of cylindrical filters to rotate via the chain or belt.

13. The apparatus of claim 1, wherein the rotary filter comprises a filter belt coupled to one or more cylinders.

14. The apparatus of claim 13, wherein a first one of the one or more cylinders is in fixed rotational communication with a helix or turbine, and the helix or turbine is configured to rotate in response to fluid flowing into or out of an interior of the at least one drain without the use of additional power or force.

* * * * *